US012320143B2

(12) United States Patent
Ramos

(10) Patent No.: US 12,320,143 B2
(45) Date of Patent: Jun. 3, 2025

(54) DRAIN PLUG FOR AN ABOVE-GROUND POOL

(71) Applicant: Belgravia Wood Limited, Hong Kong (HK)

(72) Inventor: Jaime Ramos, Moorpark, CA (US)

(73) Assignee: BELGRAVIA WOOD LIMITED, Hong Kong (CN)

( * ) Notice: Subject to any disclaimer, the term of this patent is extended or adjusted under 35 U.S.C. 154(b) by 0 days.

(21) Appl. No.: 18/433,748

(22) Filed: Feb. 6, 2024

(65) Prior Publication Data

US 2024/0175281 A1 May 30, 2024

Related U.S. Application Data

(62) Division of application No. 17/593,991, filed as application No. PCT/US2020/025121 on Mar. 27, 2020, now Pat. No. 12,060,729.

(30) Foreign Application Priority Data

Mar. 29, 2019 (CN) ..... 201920427766.6

(51) Int. Cl.
*E04H 4/14* (2006.01)
*E04H 4/00* (2006.01)

(52) U.S. Cl.
CPC ..... *E04H 4/14* (2013.01); *E04H 4/0056* (2013.01)

(58) Field of Classification Search
CPC ..... E04H 4/14; E04H 4/0056
USPC ..... 4/507
See application file for complete search history.

(56) References Cited

U.S. PATENT DOCUMENTS

| | | | | |
|---|---|---|---|---|
| 1,054,150 | A | 2/1913 | Thorsby | |
| 2,838,768 | A | 6/1958 | Fischett | |
| 3,320,623 | A | 5/1967 | D'Antonio | |
| 6,192,528 | B1 * | 2/2001 | Martinez | E04H 4/1236 4/507 |
| 6,257,550 | B1 | 7/2001 | Saputo et al. | |
| 6,978,494 | B2 | 12/2005 | Wu | |
| D536,565 | S * | 2/2007 | Shinner | D6/606 |
| 12,060,729 | B2 * | 8/2024 | Ramos | E04H 4/14 |
| 12,173,523 | B2 * | 12/2024 | Ramos | E04H 4/0056 |
| 2002/0029413 | A1 * | 3/2002 | Mussa | E04H 4/0056 4/506 |
| 2005/0000567 | A1 | 1/2005 | Wu | |

(Continued)

OTHER PUBLICATIONS

Extended European Search Report in counterpart European Patent Application No. 20782754.4 dated Dec. 4, 2023 (7 pages).

(Continued)

*Primary Examiner* — Huyen D Le
(74) *Attorney, Agent, or Firm* — Finnegan, Henderson, Farabow, Garrett & Dunner, LLP

(57) ABSTRACT

An improved drain for an above-ground pool is disclosed. A variety of above-ground pool types are considered. Above-ground pools must be drained after use before being stored in a lengthy and time-consuming process. The improved drain can advantageously remain open during the draining process allowing for improved drainage. The drain can comprise a plug member and a locking member. The plug member can be configured to attach to the locking member when open. This and other embodiments are disclosed herein.

4 Claims, 7 Drawing Sheets

(56) References Cited

U.S. PATENT DOCUMENTS

| | | | |
|---|---|---|---|
| 2008/0216877 | A1 | 9/2008 | Lawson |
| 2009/0134112 | A1 | 5/2009 | Reeves |

OTHER PUBLICATIONS

International Search Report dated Jun. 15, 2020 for International Application No. PCT/US2020/025121 (1 page).

* cited by examiner

DRAIN PLUG FOR AN ABOVE-GROUND POOL

CROSS-REFERENCE TO RELATED APPLICATIONS

This application is a divisional of U.S. application Ser. No. 17/593,991 filed Sep. 29, 2021, which is a national stage application, filed under 35 U.S.C. § 371, of International Patent Application No. PCT/US2020/025121, filed on 27 Mar. 2020, which claims benefit under 35 U.S.C. § 119 (a), of Chinese Patent App. No. 2019204277666, filed 29 Mar. 2019, the entire contents and substance of which are incorporated herein by reference in their entirety

FIELD OF THE DISCLOSURE

Embodiments of the present disclosure generally relate to above-ground pools and, more particularly, to a locking drain plug for above-ground pools.

BACKGROUND

Simply described, pools are containers of water for people to swim, wade, relax, and play in. In their many forms, pools can be above-ground pools that extend up from the ground, or below-ground pools that extend down into the ground. Above-ground pools can sometimes be temporary, providing relaxation and enjoyment along with the ability to be removed and stored after use. Below-ground pools, however, are usually more permanent. Many types of above-ground pools exist. Some designs, for example, can be inflatable. Other designs can have metal frames and sidewalls, or modular panels that attach to one another. Above-ground pools can come in any number of different shapes and sizes. While above-ground pools provide the convenience of storage and flexibility of being temporary, the need remains to fill the pool with water before each use (or season of use), and subsequently drain the water after each use (or season of use) before disassembling and storing the pool.

No matter the design, shape, or size of the above-ground pool, all pools must go through a draining process before they can be stored after use. This draining process can be time-consuming and may require user supervision. Improved methods for draining a pool and improving the user experience while maintaining the flexibility of an above-ground pool are desirable.

SUMMARY

Aspects of the presently disclosed technology relate to improved methods for draining an above-ground pool while retaining the modularity and storage convenience of the pool and improving the case of operation and time consumed for the draining process. Embodiments of the present disclosure address this need as well as other needs that will become apparent upon reading the description below in conjunction with the drawings.

In some embodiments, aspects of the disclosed technology provide a collapsible swimming pool with improved drainage devices. A pool of the present disclosure can include a drain that includes a drain hole and a drain plug member. The drain also may include a locking member. Accordingly, the drain plug member can be configured to detachably attach to the drain hole in a closed position and to the locking member in an open position. As will be appreciated, when the drain plug member is locked in the open position, the drain hole remains substantially unobstructed by the drain plug member. The drain can be constructed from a soft or hard plastic material, or a combination of the two, and the drain assembly can be disposed on a side wall of the pool through a standard attachment method such as welding.

The pool can be circular and comprise a single side (i.e., side wall), but as will be understood by those skilled in the art, the pool may include more than one side and thus take on a variety of shapes. Pools of the present disclosure also can include a base wherein the side wall is joined to the base. Pools of the present disclosure also may include at least one porthole. Pools also may include a generally transparent side wall. For example, a side wall can comprise a generally transparent sheet attached to the side wall. The transparent sheet can be attached to the side wall by one or more welds. The side wall may comprise a single, transparent layer.

In accordance with some embodiments, the pool can be supported by a frame. For example, supports such as vertical rib supports can be coupled proximate the side wall of the pool. The supports can be attached to some of the material making up the side wall and can also be attached to a support ring proximate the top of the pool.

Also disclosed herein are methods for making the previously discussed pools. Further features of the disclosed technology, and the advantages offered thereby, are explained in greater detail hereinafter with reference to specific embodiments illustrated in the accompanying drawings, wherein like elements are indicated by like reference designators.

Reference will now be made to the accompanying figures, which are not necessarily drawn to scale.

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
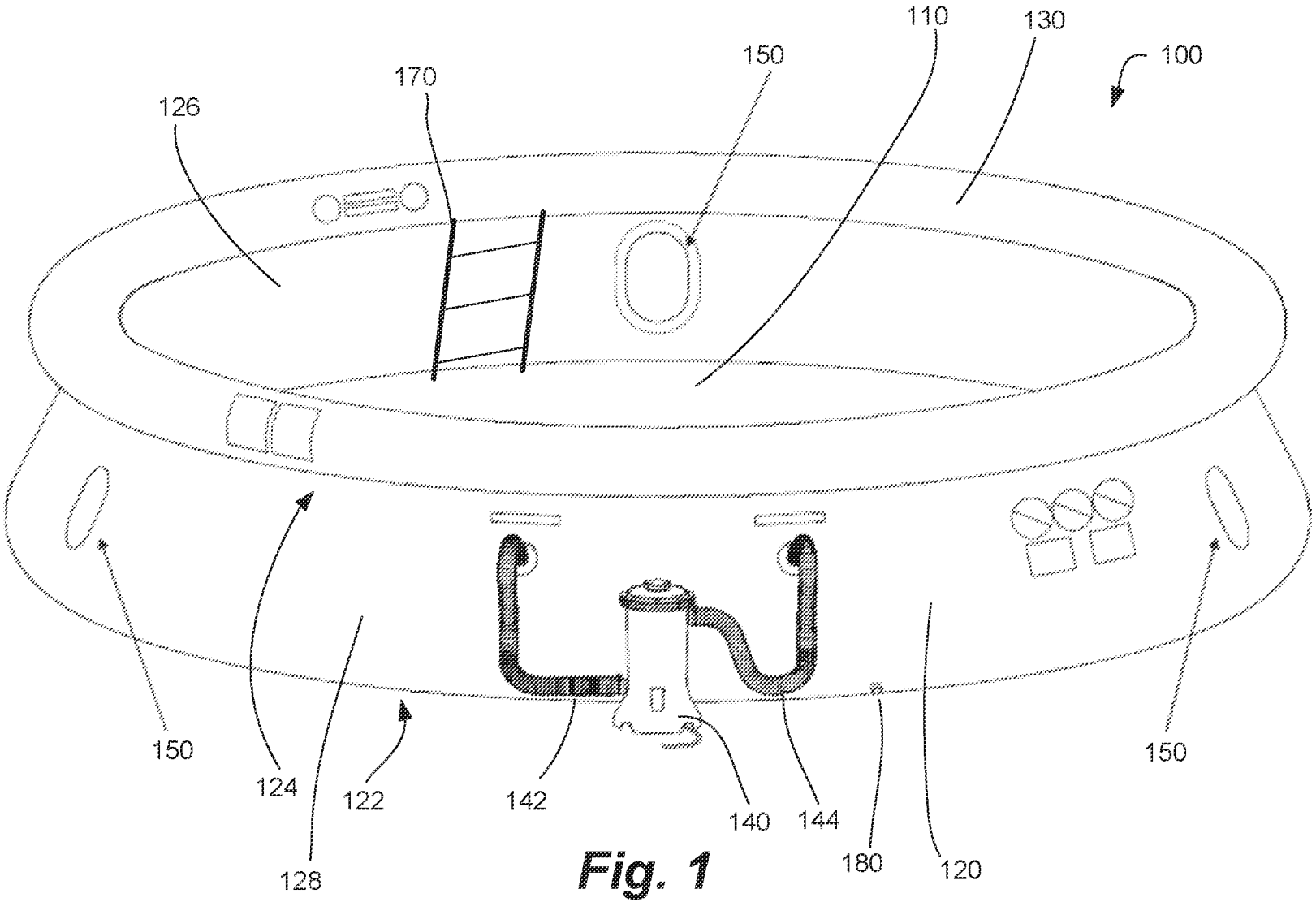
FIG. 1 is a perspective view of a pool having a drain, in accordance with some embodiments of the present disclosure.

Although certain embodiments of the disclosure are explained in detail, it is to be understood that other embodiments are contemplated. Although embodiments of the disclosure are explained in detail as being systems and methods for a pool with improved drainage assemblies, it is to be understood that other embodiments are contemplated, such as embodiments employing other types of containers, drains, plugs, materials, pools, and the like.

As described above, a problem with existing above-ground pools is that all pools must go through a draining process before they can be stored after use. This draining process is time-consuming and may require user supervision. Improved methods for draining a pool and improving the user experience while maintaining the flexibility of an above-ground pool are desirable.

A pool of the present disclosure can be provided comprising a base, a side wall (or side walls), and a drain aperture. The pool can further comprise a drain assembly configured to fit within the drain aperture. The drain assembly can be welded to the side wall (or one of the side walls) to prevent leaks and maintain structural integrity. The drain assembly also can include a drain hole, a drain plug member, and a locking member. The drain plug member can be configured to detachably attach to the drain hole through an interference fit in a closed position. As would be appreciated by one of skill in the art, the interference fit can be further sealed by the hydrostatic pressure sealing the drain plug member in the drain hole. Additionally, the drain plug member can be configured to detachably attach to the locking member in an open position such that the drain hole remains substantially unobstructed. As will be appreciated, such a configuration would provide for improved draining capabilities and overall improved user experience when storing the pool.

Pools generally are formed by joining a base, along its perimeter, to a side wall at or near one edge of the side wall. Along the edge of the side wall not joined to the base, either an upward force providing member or a shape retaining member, or a combination of the two, may be positioned. The upward force providing member or shape retaining member generally has at least a portion coupled proximate the end of the side wall not joined to the base (i.e., the top of the side wall). The upward force providing member may comprise a variety of different elements capable of aiding the transformation of the collapsible container from a collapsed configuration to an expanded configuration by erecting the side wall. For example, the upward force providing member might be a floating device that floats on liquid deposited in the container, causing the side wall to rise as more liquid is deposited in the container. The upward force providing member may also be a ring attached to the side wall and supported by support members.

A support member and/or shape retaining member may be formed from one or more support members having at least a portion coupled proximate to the side wall of the pool. For example, vertical rib supports may be used as an upward force providing member, a shape-retaining member, or both. Such vertical ribs may be formed from individual inflatable portions, or may be a foam insert, metal or polymer rod, or the like. According to some embodiments, such vertical ribs may be collapsible, being formed from collapsible inflatable portions, collapsible foam portions, or other suitable compositions.

Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

It should also be noted that, as used in the specification and the appended claims, the singular forms "a," "an" and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

According to an embodiment of the disclosure, FIG. 1 shows a container, or swimming pool, comprising a side wall with transparent portions. As shown in FIG. 1, an above-ground swimming pool (hereinafter "pool") 100 has a base 110, a side wall 120, and portholes 150.

Because the pool 100 is collapsible, the liquid in the pool 100 should be drainable. Thus, a drainage assembly 180 can be integral with the pool 100. In some embodiments, the drainage assembly 180 is a cork or similar device that is removeable from the pool 100 such that, when removed, the water from the pool 100 may be drained. The drainage assembly 180 also may be a valve enabling control of draining the pool 100. One skilled in the art would appreciate that the drainage assembly 180 may be many devices enabling easy draining of the pool 100, safely and environmentally. The drain assembly 180 may also comprise a hard or soft plastic material, or combination thereof, and can be disposed substantially within a drain aperture in the side wall 120.

Figure 2:
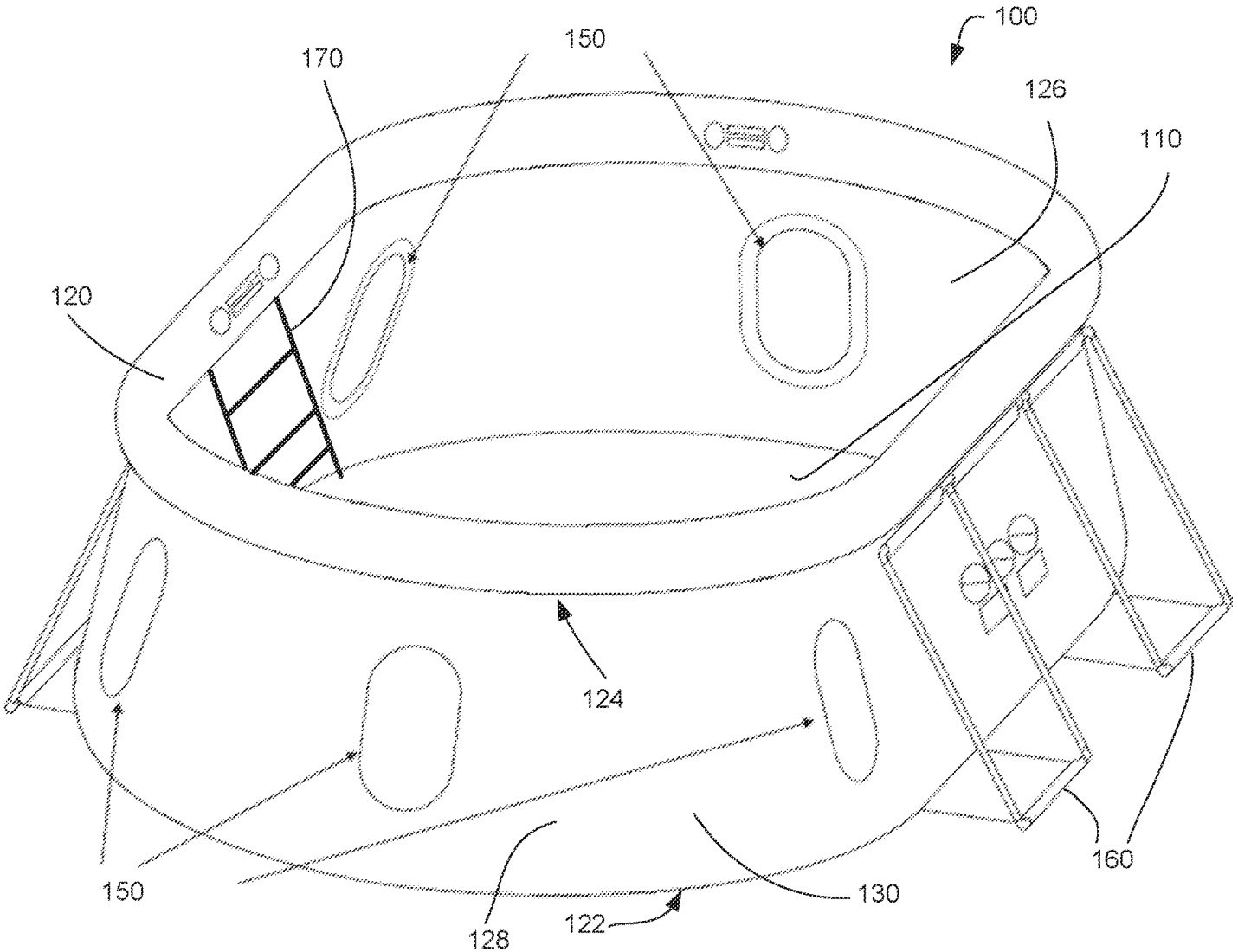
FIG. 2 is a perspective view of another pool having a drain and braces, in accordance with some embodiments of the present disclosure.
Figure 3:
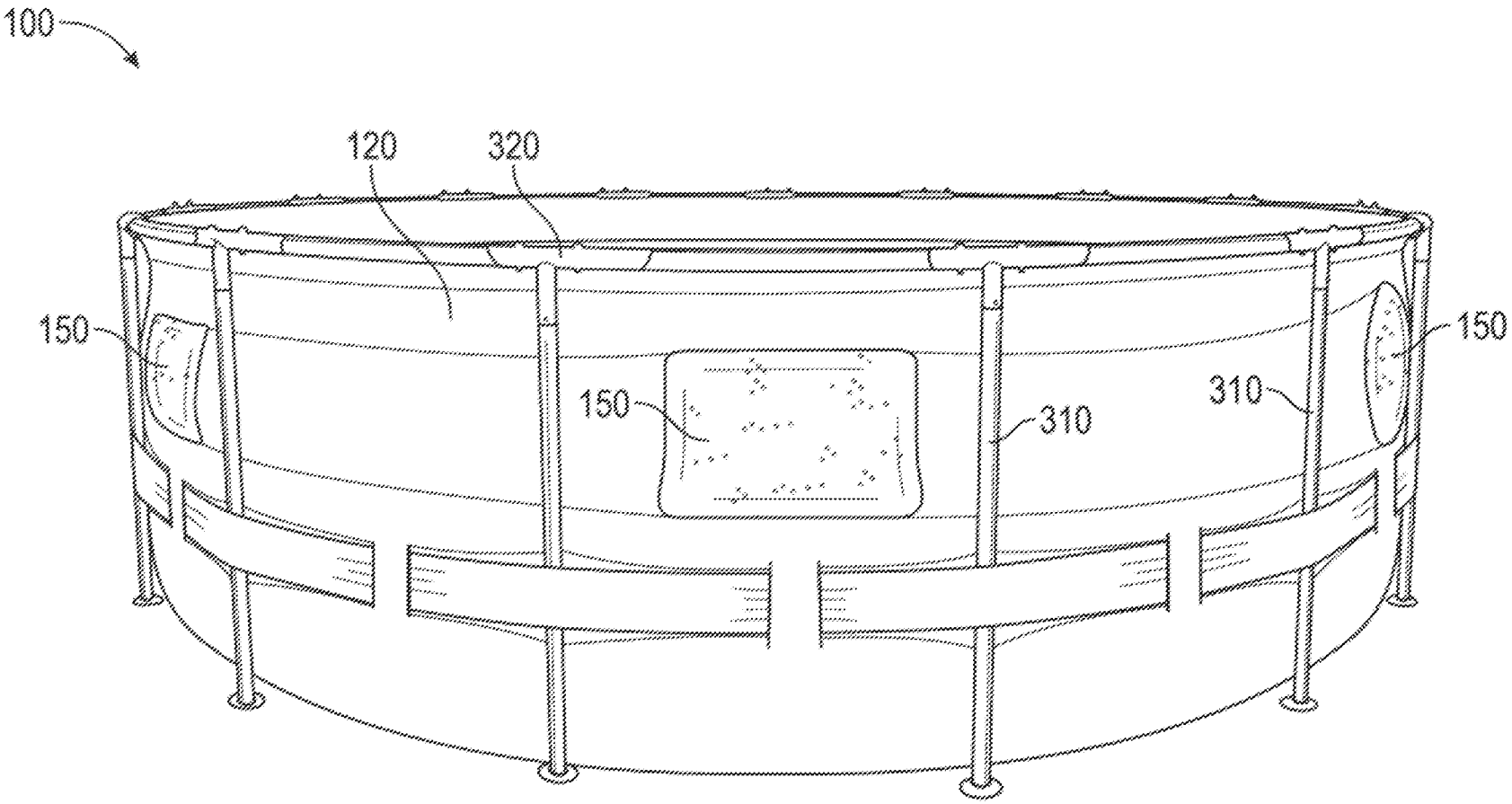
FIG. 3 is a view of the exterior of a pool having a frame and support members, in accordance with some embodiments of the present disclosure.

As shown in FIGS. 1-3, the pool 100 may comprise a drain assembly 180. The drain assembly 180 can be located in various locations on the pool 100 as appropriate. For example, the drain assembly 180 can be disposed on a side wall 120 of the pool and can substantially surround a drain hole aperture formed in a side wall 120. The drain assembly 180 also can be disposed on a base 110 of the pool as appropriate. The drain assembly 180 also can be disposed on a bottom 122 of the side wall 120. In some embodiments, the drain assembly can be disposed on an area substantially between the side wall 120 and the base 110.

Figure 4B:
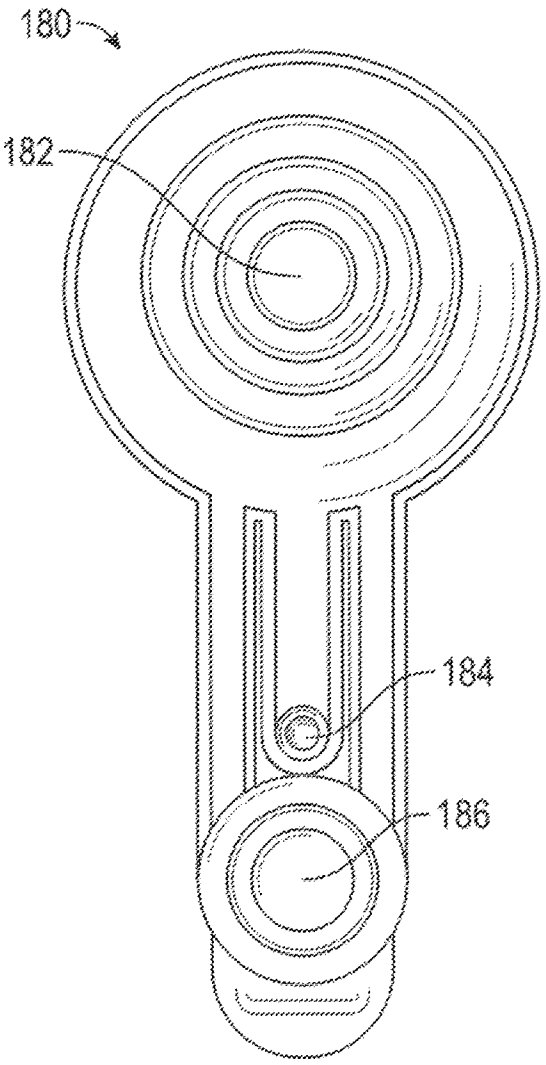
FIG. 4*b* is a drain assembly for a pool, in accordance with some embodiments of the present disclosure.
Figure 4A:
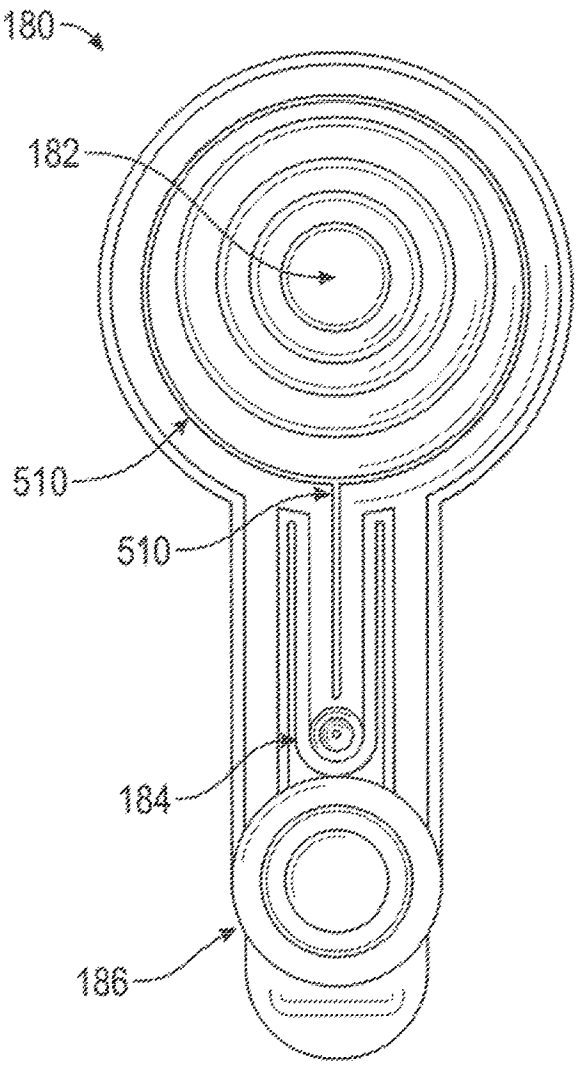
FIG. 4*a* is a drain assembly for a pool, in accordance with some embodiments of the present disclosure.

FIGS. 4*a* and 4*b* illustrate an embodiment of a drain assembly 180 for a pool 100. The drain assembly 180 can be fitted around a drain aperture cut into a side wall or base of the pool (not shown). The drain assembly 180 can comprise a drain hole 182, a drain plug member 186, and a locking member 184. Welds 510 can be used to attach the drain assembly 180 to a side wall 120 or base 110 of the pool 100. The drain assembly 180 can comprise any hard or soft plastic material, or combination thereof, including but not limited to, polyethylene, polypropylene, polyethylene terephthalate, polystyrene, polystyrene butadiene, polybutylene succinate, polyester, polycarbonate, polyvinyl chloride, polymethyl methacrylate, acrylonitrile butadiene styrene, chlorinated polyvinyl chloride, nylon, polylactic acid, polytetrafluoroethylene, or a combination thereof.

Figure 5A:
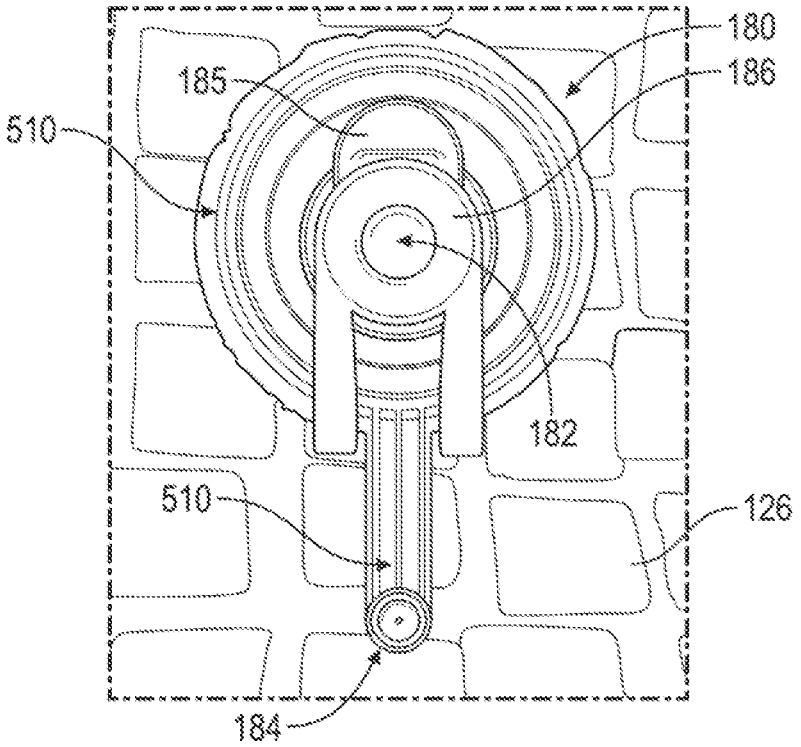
FIG. 5*a* is an interior view of a pool having a drain assembly in a closed position, in accordance with some embodiments of the present disclosure.
Figure 5B:
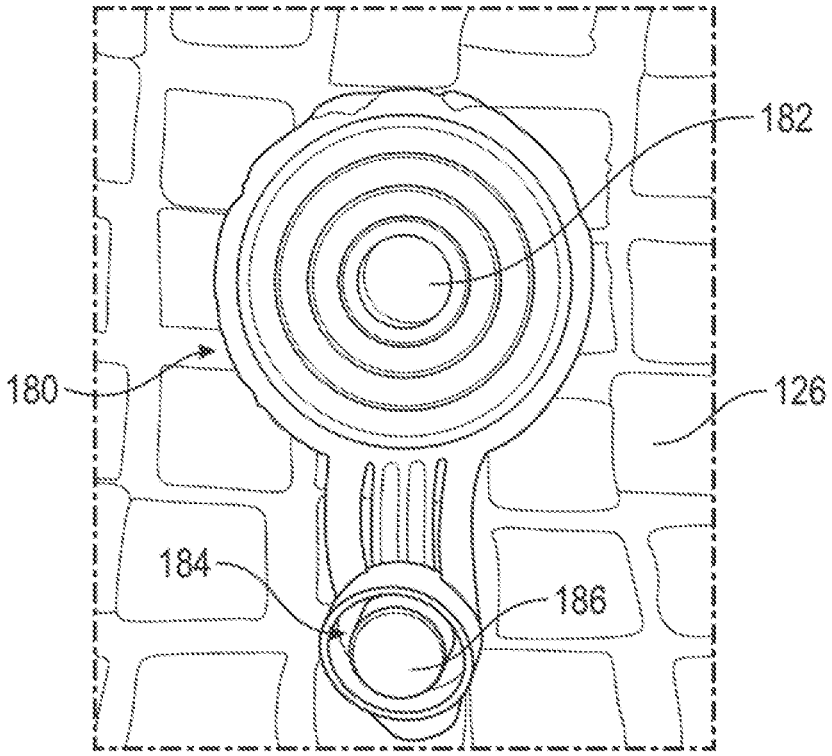
FIG. 5*b* is an interior view of a pool having a drain assembly in an opened position, in accordance with some embodiments of the present disclosure.

As shown in FIGS. 5*a* and 5*b*, the drain assembly 180 can be attached to an interior side wall 126 of a pool through welds 510. The welds 510 may join the drain assembly to the interior side wall 126 or any other part of the pool 100 by way of a number of commonly known suitable techniques, such as sewing, adhesives, bonding, lamination, RF welding, other suitable joining techniques, and the like. The drain assembly 180 can comprise a drain hole 182, a drain plug member 186, and a locking member 184. In some embodiments, the drain hole 182 and welds 510 can be arrange in a concentrically circular pattern to match the shape of a drain aperture cut into an interior side wall 126. It is understood that the drain hole 182 and welds 510 can be arranged in any practical shape.

In some embodiments, the locking member 184 can be radially disposed to the drain hole 182 and also can be fastened to a side wall 126 through welds 510. In some embodiments, the locking member 184 and the drain hole 182 can be connected through a member, or multiple members, comprising the same material as the locking member 184 and the drain hole 182. In some embodiments, the locking member 184 can be separate from the drain hole 182 and fastened to an interior side wall 126 on its own. As shown, the locking member 184 can be configured in such a shape to receive the drain plug member 186. The locking member 184 can comprise a circular prong configured to adjoin a circular indentation in the drain plug member 186 through an interference fit, as illustrated in FIGS. 5*a* and 5*b*. In such an embodiment, the circular prong of the locking member 184 can have a smaller radius than that of the drain plug member 186, such that the drain plug member 186 can fit over the circular prong. It is understood that other methods of affixing the drain plug member to the locking member are contemplated, including but not limited to, press fit, friction fit, screw threading, and others known to one of ordinary skill in the art. In some embodiments, the drain plug member 186 can be affixed to the drain hole 182. As shown, the drain plug member 186 can be configured in such a shape to match the shape of the drain hole 182.

In some embodiments, the drain plug member 186 can be circular to match the circular drain hole 182. As shown, the drain plug member 186 can comprise a radial channel around the circumference of the drain plug member configured to fit over the drain hole 182 ridge in an interference fit. As would be appreciated by one of skill in the art, such an embodiment would provide an increased seal during use due to the hydrostatic pressure of the pool pushing on the drain plug member to increase the interference fit. The drain plug member 186 can have an additional radial channel, or ring, concentric with the first ring around the circumference of the drain plug member 186. The second ring can be configured to fit over the locking member 184 in an interference fit. In such an example, the interference fit can keep the drain plug member 186 fastened to the locking member 184 and substantially clear of the drain hole 182. The first and second rings can be disposed on opposite faces of the drain plug member 186. For example, the first ring to fasten to the drain hole 182 can be on a front face of the drain plug member 186, and the second ring to fasten to the locking member 184 can be on a back face of the drain plug member 186 (opposite from the first ring). An example of the first and second rings can be seen in FIGS. 5*a* and 5*b*.

The drain plug member 186 can further comprise a flap 185 made from excess material to provide a flap for easier gripping on the drain plug member. As would be appreciated, such a flap 185 would provide for easy detachment of the drain plug member 186 from the drain hole 182 or the locking member 184. As shown in FIG. 5*a*, the drain plug member 186 can be configured to detachably attach to the drain hole 182 in a closed position. Using the flap 185, a user of the pool can easily detach the drain plug member 186 from the drain hole 182 and transition to an open position.

Further, as shown in FIG. 5*b*, the drain plug member 186 can be configured to detachably attach to the locking member 184 in an open position. As would be appreciated by one of ordinary skill in the art, such an embodiment would retain the drain plug member 186 in the open position and leave the drain hole 182 substantially unobstructed. The open position therefore can provide improved drainage capabilities of the pool and improved user experience when draining the pool before storage.

Figure 6C:
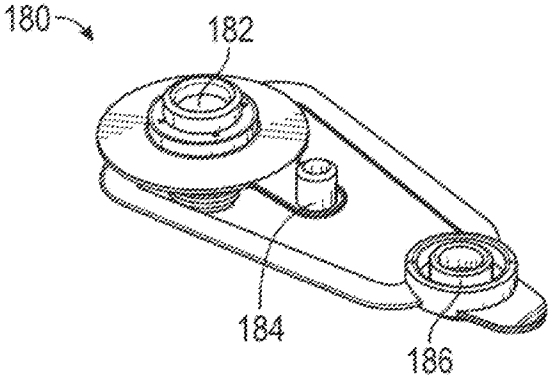
FIG. 6*c* is a drain assembly for a pool, in accordance with some embodiments of the present disclosure.
Figure 6B:
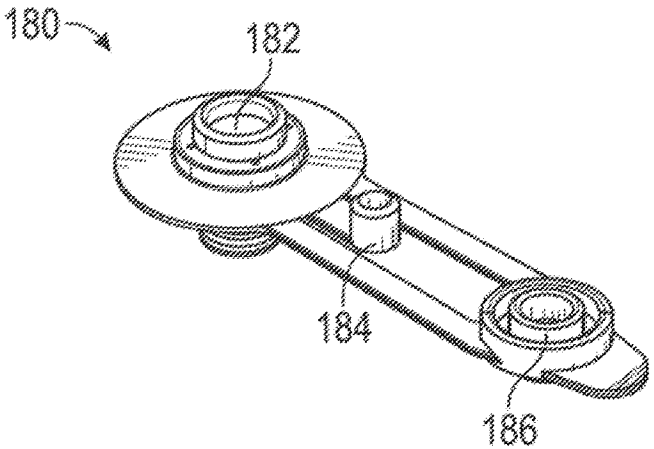
FIG. 6*b* is a drain assembly for a pool, in accordance with some embodiments of the present disclosure.
Figure 6A:
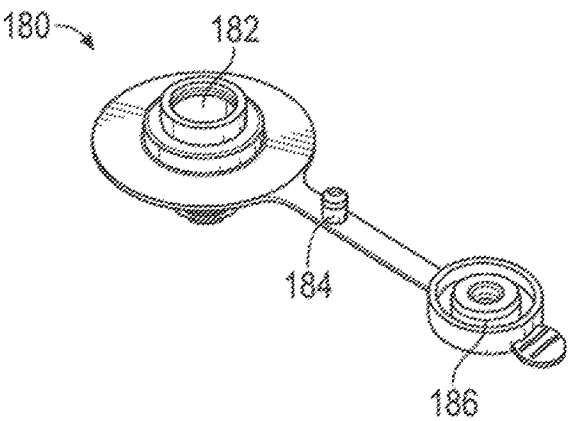
FIG. 6*a* is a drain assembly for a pool, in accordance with some embodiments of the present disclosure.

FIGS. 6*a*-6*c* illustrate alternative embodiments of an improved drainage assembly 180 for an above-ground pool. As shown, some embodiments can comprise a drain hole 182, a locking member 184, and a drain plug member 186. As shown, the drain plug member 186 can be connected to the drain hole 182 in a number of ways. In some embodiments, the drain plug member 186 can connect to the drain hole 182 through one or more attaching members comprising the same material as the drain assembly 180. In some embodiments, the attaching members can be welded to the same surface as the drain assembly 180, such as a pool side wall 120 or base 110.

In some embodiments, the drain plug member 186 can be separate from the locking member 184. For example, the locking member 184 can be a separate unit made of hard or soft plastic and welded to the pool side wall 126 or base 110 near the drain hole 182. In such an embodiment, there would be no material connecting the drain hole 182 to the locking member 184 except when the drain plug member 186 was detachably attached to the locking member 184.

In some embodiments, the drain plug member 186 can comprise screw threading on two or more sides. For example, the drain plug member 186 can fit over the drain hole 182 with an interference fit and contain screw threading on the surface opposite the drain hole 182 configured to rotatably attach the drain plug member 186 to corresponding screw threading on the locking member 184. Alternatively, the drain plug member 186 can attach to the drain hole 182 with more screw threading as opposed to an interference fit, providing screw threading on both sides of the drain plug.

In some embodiments, the drain assembly 180 can comprise a drain hole 182 and a drain plug member 186. In such an embodiment, the drain plug member 186 can be retractable when not fastened to the drain hole 182 such that the retracted drain plug member 186 remains substantially clear of the drain hole 182. For example, the drain plug member 186 can comprise a flap that extends from an attachment to the drain hole 182 through the side wall 126 or base 110 of the pool 100. A user of the pool 100 can pull on the flap to retract the drain plug member 186 into the side wall 126, the base 110, or an area surrounding the drain hole 182 such that the drain hole 182 remains substantially unobstructed by the drain plug member 186.

Figure 8:
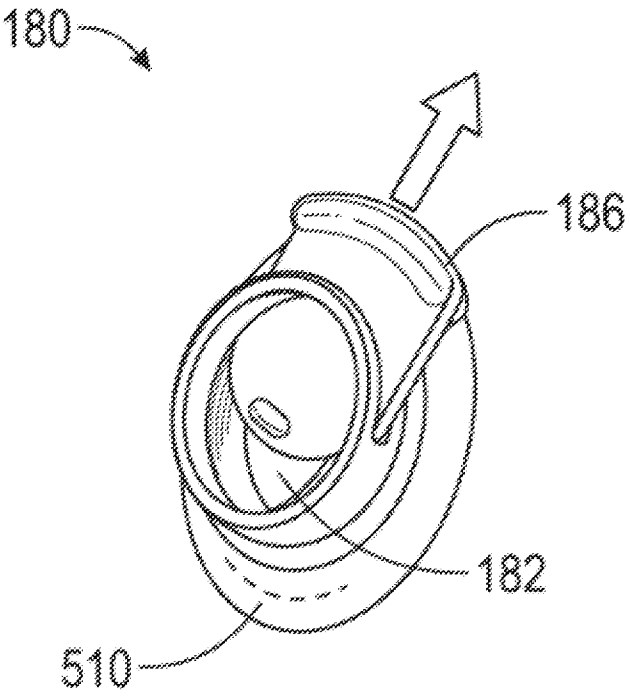
FIG. 8 is a drain assembly for a pool, in accordance with some embodiments of the present disclosure.
Figure 7:
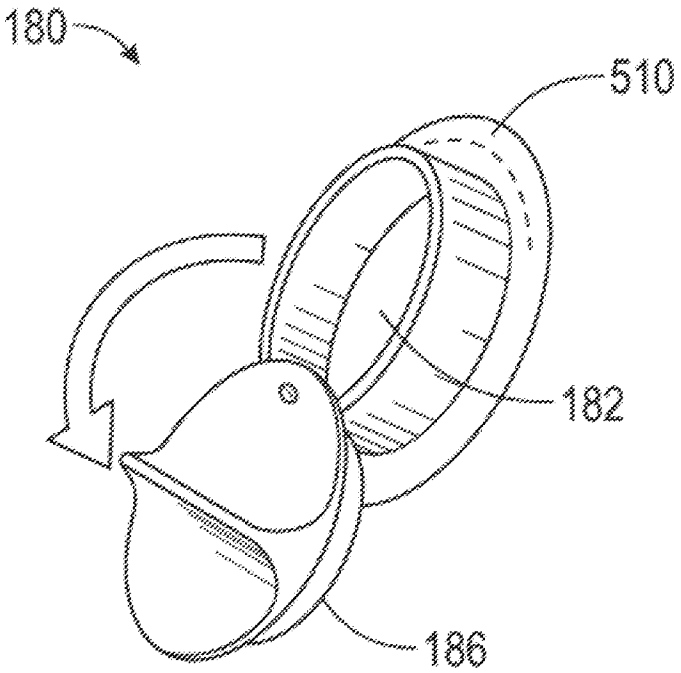
FIG. 7 is a drain assembly for a pool, in accordance with some embodiments of the present disclosure.

In some embodiments, the drain hole 182 can abut the drain plug member 186 such that the drain plug member 186 can be configured to slidably rotate away from the drain hole 182, as shown in FIG. 7. In other embodiments, the drain hole 182 can comprise a sliding track for the drain plug member 186 to slide back and forth away from the drain hole 182, as shown in FIG. 8. In such embodiments, the drain plug member 186 can be configured to have sufficient frictional force with the drain hole 182 to remain open. In other embodiments, the drain plug member 186 can communicate with a locking member to remain in the open position.

As noted previously, the pool 100 may be made in a variety of shapes, including, but not limited to, circular, as shown in FIGS. 1, 3, and 4, elliptical, as shown in FIG. 2, rectangular, square, oblong, oval-shaped, elliptical, rectangular with rounded corners, and the like. Thus, it will be apparent to one skilled in the art that the configuration of the pool 100 may be many shapes. Additionally, the pool 100 may be made in a variety of sizes. The varied sizes and shapes of the pool 100 may result in the pool 100 having more than one side wall 120 forming the perimeter of the pool 100.

The pool 100 may be a frame pool, as shown in FIGS. 3 and 4, or a pop-up type of pool, as shown in FIGS. 1 and 2, both of which are collapsible in nature. As will be appreciated, the pop-up pool is adapted to rise with the amount of water inserted into pool. In some embodiments, and as shown in FIG. 2, a pop-up pool 100 also may be outfitted with external braces or frames 160 for additional support. The frame pool is typically pre-fabricated and includes a plurality of external vertical braces or frames for supporting the frame pool above the ground. As shown in FIGS. 3 and 4, a frame pool 100 may comprise external vertical braces 310 and a top brace 320. As one skilled in the art would appreciate, other types of pools may be used with the present disclosure.

As previously discussed, the pool 100 typically is formed from a base 110 and at least one side wall 120. The base 110 and side wall 120 may be formed from multiple varied materials. The base 110 and side wall 120 may be formed of the same material or different materials, and in embodiments involving more than one side wall 120, each side wall 120 may be formed of the same or different materials. For example, in some embodiments, the base 110 and side wall 120 of the pool 100 may be formed from a natural textile (e.g., burlap, jute, etc.) or synthetic material (e.g., plastic, polyurethane, PVC, nylon, etc.). In some embodiments, the base 110 may be formed from a natural textile and the side wall 120 may be formed of a synthetic material. Many materials (including water-permeable textiles, etc.) may be used to construct a pool; the materials, however, should be treated to retain water. For example, such materials could be adhered to, laminated with, coated with, or bonded to a material impermeable to water. In accordance with the embodiment shown in FIG. 1, the base 110 may be formed from a nylon shell, which may be laminated or otherwise treated to hold water. For example, the nylon shell might be bonded to another material, such as a polyurethane, PVC, vinyl, or other suitable impermeable lining to provide the desirable waterproof qualities, and to provide a more pleasing tactile quality to the interior of the pool 100. Similarly, the side wall 120 of the pool 100 may be constructed from these materials, or other materials having similar suitable qualities. The materials that are used may be selected for their durability.

For example, the base 110 may be formed from materials that are more durable than the side wall 120, as this section of the pool 100 would likely be subjected to more wear than that experienced by the side wall 120. Also, as described, the base 110 and side wall 120 may be formed from a combination of materials, which may be adhered or bonded together. The materials used for the various portions of the pool 100, including, for example, the base 110 and the side wall 120, may be joined by way of a number of suitable techniques, such as sewing, adhesives, bonding, lamination, RF welding, other suitable joining techniques, and the like. The connection of the base 110 to the side wall 120 may be along the bottom 122 of the side wall 120. The base 110 includes a perimeter, wherein the side wall 120 may be connected about the perimeter of the base 110.

In some embodiments, the side wall 120 may include an inner wall 126 and an outer wall 128. The inner wall 126 may be scalable to the outer wall 128 by welding, adhesives, or the like. The side wall 120 may be inflatable or non-inflatable. Further, the side wall 120 may be non-spring activated.

As noted above, in some embodiments, a large portion of the side wall 120 may be transparent in nature. Such a portion would be larger than the portholes 150 and would comprise a portion or all of the side wall 120 itself. For example, half of the side wall 120 may be transparent in nature, or the entire side wall 120 may be transparent. As will be appreciated, side walls 120 having a substantial portion being transparent are more desirable to consumers as they enable a significantly larger viewing area, enabling the user to see into or out of the pool.

In some embodiments, the side wall 120, having a substantial portion being transparent, may comprise a clear window sheet 500 attached between a clear inner wall 126 and a clear outer wall 128. In some embodiments, multiple clear window sheets 500, of sufficient size, may be welded together to form a unified side wall 120. In some embodiments, a single clear window sheet 500, of sufficient thickness, may form a unified side wall 120. In some embodiments, the unified side wall 120, having a substantial portion being transparent, takes the place of a side wall 120 with portholes 150, with all other components of the pool 100 attaching to the side wall 120 as described elsewhere in this disclosure. In some embodiments, the side wall 120 can comprise a plurality of side wall sections (e.g., two or more side wall sections), and multiple clear window sheets 500, of sufficient size, may be welded together to form a side wall section. In some embodiments, some side wall sections can be transparent while other side wall sections can be solid. For example, the side wall sections can alternate between transparent and solid or be arranged in any other pattern. As would be appreciated by one of ordinary skill in the art, such an embodiment would provide greater transparency than simply having portholes and provide another level of user customization to arrange the transparent side walls sections as desired.

As shown in FIGS. 1-3, the pool 100 may comprise a porthole 150, or a plurality thereof. The portholes 150 may be similar to a window permitting one to see into the pool 100 or out of the pool 100. The portholes 150 may further enable one to determine the level of liquid within the pool 100. As also shown, for example, in FIGS. 1 and 2, the portholes 150 may be of a particular shape. In some embodiments, the shape of the portholes 150 may be determined by the shape of apertures cut into the walls 126, 128 of the pool 100. As shown in FIG. 1, the shape of the portholes 150 may be elliptical or substantially elliptical. As shown in FIG. 2, in some embodiments, the shape of the portholes 150 may be circular or substantially circular. As shown in FIG. 5*a*, in some embodiments, the shape of the portholes may be substantially rectangular with rounded corners. As will be apparent to one skilled in the art, however, the porthole 150 may be many shapes, such as square, rectangular, oblong, and the like. In some embodiments, as shown in FIGS. 1 and 2, the portholes 150 may be spaced evenly about the side wall 120.

Portholes 150 may comprise a generally transparent window sheet 500 that is attached to the side wall 120 (or inner wall 126). Moreover, the window sheet may be attached between the inner wall 126 and the outer wall 128. In other words, the window sheet 500 may be "sandwiched" to and between the inner wall 126 and the outer wall 128, and attached to both walls by conventional means. For example, the window sheet 500 may be attached to the side wall 120 by welding the window sheet 500 to the side wall 120 with one or more welds 510. In some embodiments, the welds 510 may be made around the circumference of the aperture cut into the side wall 120 and may have substantially the same shape as the aperture. The welds 510 may be continuous welds, which may help prevent the fluid in the pool 100 from leaking. Successive welds 510 may be concentric and further from the center of the aperture in side wall 120, as illustrated in FIGS. 5*a* and 5*b*. Specifically, there may be two welds 510, three welds 510, four welds 510, five welds 510, or more, moving outward from the center of the aperture in the side wall 120. The successive welds 510 may aid in reinforcing the pothole 150 to make it more durable than known portholes. That is, since there may be a plurality of welds 510, if one weld 510 fails, the other welds 510 may maintain the integrity of the porthole 150 and thus the pool 100. Alternatively or additionally, the window sheet 500 may be attached to the side wall 120 by using an adhesive substance.

The window sheet 500 may be substantially similar in shape to the aperture in side wall 120, but it may also be of a different shape. If the window sheet 500 is a different shape than the aperture it covers, the window sheet 500 may still be attached by welding or adhesive, however the welds need not be concentric. For example, there may be a weld near the outer edge of the window sheet 500, and a second weld closer to and surrounding the aperture in the wall.

In some embodiments, the window sheet 500 can be attached to the side wall 120 by securing it between inner wall 126 and outer wall 128. In such an embodiment, welding or adhesives may be used in a manner similar to that discussed above with respect to FIGS. 5*a* and 5*b*.

The window sheet 500 may comprise a clear flexible polymer, such as flexible PVC. Likewise, the side wall 120 (or inner wall 126) also may be a flexible polymer, such as flexible PVC. The window sheet 500 and/or side wall 120 (or inner wall 126) can further comprise a plasticizer material. As would be appreciated by one of ordinary skill in the art, the addition of a plasticizer would reduce the brittleness of the pure PVC material and increase the overall material strength of the window sheet and eliminate the need for reinforcing material. The addition of a plasticizer would increase the flexibility and durability of the window sheet. Such an embodiment can provide numerous advantages, such as retaining structural integrity and resisting rupture while being a flexible and easily collapsible material. In other words, the window sheets may be bent, flexed, and strained during storage and packaging, but will remain robust and structurally sound when the pool is filled and in use. Additionally, as will be appreciated, use of two similar materials may make attaching the window sheet 500 and the side wall 120 easier and also increase the strength of the attachment. Specifically, in some embodiments, such as embodiments employing high frequency welding (or RF welding) to form welds 510, it may desirable to have materials with similar melting points and chemical compositions to form a stronger weld 510 and make the welding process less complex.

In some embodiments, the portholes 150 may aid in safety, as the portholes 150 may enable improved viewing into the pool 100 through the side wall 120. As would be appreciated by one of ordinary skill in the art, such an embodiment would be improved provided the window sheets in the portholes were sufficiently strong to not require a wire mesh or any reinforcing material. If the portholes 150 are designed to be removable by suitable means, a porthole 150 may also be used as a drainage device, enabling quick emptying of the liquid of the pool 100. Thus, the portholes 150 may be integrally formed during manufacturing of the side wall 120, or may be removable, wherein the various sheets are removably attached via a waterproof and leak-proof method. The portholes 150, however, may also be attached via a non-removable method as discussed above.

The pool 100 may further include a pump device 140. The pump device 140 can be adapted as a circulation system, and beneficially a cleaning system. The pump device 140 can comprise a first tube 142 coupling a suction port of the pump 140 in fluid communication with a main drain or mobile cleaning device (neither shown) which draws water and settled debris from the bottom of the pool. The pool pump 140 may further comprise a second tube 144 to a coupling device which diverts a small portion of pool "return" water pumped from an outlet port of the pump 140. Further, pump 140 may be adapted to provide a jet of air bubbles in the water, for a Jacuzzi or spa effect.

FIG. 2 illustrates the pool 100 having a brace or structural support 160. The support 160 may include vertical rib supports and may be coupled proximate to the side wall 120 of the pool 100. For example, the support 160 may be inserted within the material making up the side wall 120. The support members may comprise at least a portion of the flotation device 110 or a support member and may have at least a portion coupled to the top of the side wall 120 and vertically along the side wall 120 to provide buoyancy and/or rigidity to the side wall 120. The support members 160 may comprise, for example, one or more inflatable bladders, collapsible foam, removable support members, or the like. One skilled in the art would appreciate that the support members 160 may be used on a frame pool, as well as a pop-up pool for supporting the pool above the ground. In some embodiments, the support members 160 are positioned outside the pool 100.

The pool 100 may include a ladder 170 to enable one to enter and/or exit the pool 100. The ladder 170 may be integral with the brace 160, or not. The ladder 170 may further be insertable into the pool 100, enabling one to exit the pool 100. Because a rim of the pool 100 is above the ground, the ladder 170 is preferably flush with the rim for easy entry/exit from the pool 100.

Methods of manufacturing and assembling a pool 100 also are within the scope of this disclosure. In some embodiments, for example, a pool 100 may be manufactured as is known in the art, with additional method steps added to provide the drain 180. For example, an aperture may be cut in the side wall 120. A drain assembly 180 may be attached to side wall 120 as described above by welding, adhesives, or other known methods. In some embodiments of pool 100 having an inner wall 126 and an outer wall 128, drain assembly 180 may be attached to inner wall 126 only, between the inner wall 126 and the outer wall 128, or to outer wall 128 only. In some embodiments, the aperture may be cut in the base 110, a bottom 122 of the side wall 120, or an area between the base 110 and the side wall 120.

In some embodiments, as discussed above, one or more welds 510 may be used to secure the drain assembly 180 to side wall 120 or between inner wall 126 and outer wall 128. Welds 510 may be made around the perimeter of the aperture in side wall 120. In some embodiments, a plurality of welds 510 is employed. These welds 510 may be oriented in any way sufficient to provide a water tight seal. In some embodiments, the welds 510 may be arranged in a concentric manner around the aperture in the side wall 120 as illustrated in FIGS. 5*a* and 5*b*. This arrangement allows one or more of the welds 510 to fail, while still retaining a water tight seal around the drain assembly 180. The drain assembly 180 can be joined to another part of the pool, such as the side wall 120, by way of a number of suitable techniques, such as sewing, adhesives, bonding, lamination, RF welding, other suitable joining techniques, and the like.

An embodiment of the present disclosure can be implemented according to at least the following:

Clause 1: An above-ground pool comprising: a base; at least one sidewall defining an entire interior pool area and joined to the base; and a drain disposed around an aperture in, and affixed to, one of the base and the at least one sidewall, the drain comprising: a drain hole; a locking member; and a drain plug member configured to detachably attach to (i) the drain hole and (ii) the locking member such that, when the drain plug is detachably attached to the drain hole, the drain is in a closed state and a watertight seal is formed between the drain plug member and the drain hole, and when the drain plug is detachably attached to the locking member, the drain is in an open state.

Clause 2: The above-ground pool of clause 1, further comprising a frame comprising a plurality of horizontal pool support members and a plurality of vertical support members.

Clause 3: The above-ground pool of clause 1, wherein the at least one sidewall is a unitary sidewall formed from a single sheet.

Clause 4: The above-ground pool of clause 1, wherein the base is rectangular, rectangular with rounded corners, square, square with rounded corners, circular, oval, oblong, elliptical, triangular, pentagonal, hexagonal, octagonal, or decagonal.

Clause 5: The above-ground pool of clause 1, wherein the at least one sidewall and base comprise polyurethane, PVC, nylon, vinyl, or a textile coated with a material impermeable to water.

Clause 6: The above-ground pool of clause 1, wherein the drain plug member is configured to detachably attach to the drain hole in the closed state through an interference fit between the drain plug member and the drain hole.

Clause 7: The above-ground pool of clause 1, wherein the locking member is configured to receive the drain plug member in the open state through an interference fit between the locking member and the drain plug member.

Clause 8: The above-ground pool of clause 1, wherein the drain is affixed to the one of the base or the at least one sidewall through one or more welds.

Clause 9: The above-ground pool of clause 1, wherein the drain plug member further comprises a flap disposed on an external surface of the drain plug member, the flap configured to allow a user to grip the drain plug member.

Clause 10: A drain for an above-ground pool, the drain comprising: a drain hole; a locking member; and a drain plug member configured to detachably attach to (i) the drain hole and (ii) the locking member such that, when the drain plug member is detachably attached to the drain hole, the drain is in a closed state and a watertight seal is formed between the drain plug member and the drain hole, and when the drain plug member is detachably attached to the locking member, the drain is in an open state; wherein the drain is disposed around an aperture in, and affixed to, one of a base and at least one sidewall of the above-ground pool.

Clause 11: The drain of clause 10, wherein the drain plug member is configured to detachably attach to the drain hole in the closed position through an interference fit.

Clause 12: The drain of clause 10, wherein the locking member is configured to receive the drain plug member in the open position through an interference fit.

Clause 13: The drain of clause 10, wherein the drain is disposed around the aperture with one or more welds.

Clause 14: The drain of clause 10, wherein the drain plug member further comprises a flap disposed on an external surface of the drain plug member, the flap configured to allow a user to grip the drain plug member.

Clause 15: The drain of clause 10, wherein the locking member comprises a circular prong radially disposed from the drain hole, the circular prong configured for receipt by the drain plug member.

Clause 16: The drain of clause 15, wherein the drain plug member comprises a circular indentation configured to receive the circular prong and detachably attach the drain plug member to the circular prong.

Clause 17: A drain for an above-ground pool, the drain comprising: a drain hole including a sliding track; and a drain plug member slidably affixed to the sliding track, the drain plug member configured to slidably engage the drain hole such that, when the drain plug member is slidably engaged to the drain hole, the drain is in a closed state and a watertight seal is formed between the drain plug member and the drain hole, and when the drain plug member is slidably disengaged from the drain hole, the drain is in an open state; wherein the drain is configured for being affixed to and disposed around an aperture in one of a base or at least one sidewall of the above-ground pool.

Clause 18: The drain of clause 17, wherein the drain is configured to be disposed around the aperture with one or more welds.

Clause 19: The drain of clause 17, wherein the drain plug member further comprises a flap disposed on an external surface of the drain plug member, the flap configured to allow a user to grip the drain plug member.

Clause 20: A drain for an above-ground pool, comprising: a drain hole; and a drain plug member abutting and attached to the drain hole, the drain plug member configured to rotably engage the drain hole such, when the drain plug member is rotably engaged to the drain hole, the drain hole is in a closed state and a watertight seal is formed between the drain plug member and the drain hole, and when the drain plug member is rotably disengaged from the drain hole, the drain is in an open state; wherein the drain is configured for being affixed to and disposed around an aperture in one of a base or at least one sidewall of the above-ground pool.

Clause 21: The drain of clause 20, wherein the drain is configured to be disposed around the aperture with one or more welds.

Clause 22: The drain of clause 20, wherein the drain plug member further comprises a flap disposed on an external surface of the drain plug member, the flap configured to allow a user to grip the drain plug member.

In this description, numerous specific details have been set forth. It is to be understood, however, that implementations of the disclosed technology can be practiced without these specific details. In other instances, well-known methods, structures, and techniques have no been shown in detail in order not to obscure an understanding of this description. References to "one embodiment," "an embodiment," "some embodiments," "example embodiment," "various embodiments," etc., indicate that the implementation(s) of the disclosed technology so described can include a particular feature, structure, or characteristic, but not every implementation necessarily includes the particular feature, structure, or characteristic. Further, repeated use of the phrase "in one embodiment" does not necessarily refer to the same implementation, although it may.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

What is claimed is:

1. A method for assembling a drainage assembly, the method comprising:

providing a drain hole;

providing a locking member;

providing a drain plug member;

connecting the drain plug member to the drain hole through at least one attaching member; and configuring the drain plug member to rotatably attach to the locking member.

2. The method of claim 1, wherein providing the drain hole and the drain plug member further comprises connecting the drain plug member to the drain hole through an attaching member comprising the same material as the drain hole.

3. The method of claim 2, further comprising welding the attaching member to the same surface as the drain.

4. The method of claim 1, wherein the locking member comprises hard or soft plastic.

* * * * *